US006705088B2

(12) United States Patent
Martling et al.

(10) Patent No.: US 6,705,088 B2
(45) Date of Patent: Mar. 16, 2004

(54) ADVANCED CROSSFIRE TUBE COOLING SCHEME FOR GAS TURBINE COMBUSTORS

(75) Inventors: Vincent C. Martling, Boynton Beach, FL (US); James H. Leahy, Jr., Tequesta, FL (US); Daniel J. Sullivan, Palm Beach Gardens, FL (US)

(73) Assignee: Power Systems Mfg, LLC, Jupiter, FL (US)

( * ) Notice: Subject to any disclaimer, the term of this patent is extended or adjusted under 35 U.S.C. 154(b) by 0 days.

(21) Appl. No.: 10/116,850

(22) Filed: Apr. 5, 2002

(65) Prior Publication Data

US 2003/0188537 A1 Oct. 9, 2003

(51) Int. Cl.[7] ..... F02C 7/20

(52) U.S. Cl. ..... 60/800; 60/39.821; 60/752; 60/799

(58) Field of Search ..... 60/39.821, 39.826, 60/752, 799, 800, 39.76, 39.823, 39.827, 39.83, 750, 751, 755, 756, 757, 805, 806

(56) References Cited

U.S. PATENT DOCUMENTS

| | | | | |
|---|---|---|---|---|
| 2,832,195 A | * | 4/1958 | Weissborn, Jr. | 60/39.97 |
| 4,249,372 A | | 2/1981 | White | |
| 5,001,896 A | | 3/1991 | Hilt et al. | |
| 5,361,577 A | | 11/1994 | Cromer | |
| 5,896,742 A | | 4/1999 | Black et al. | |
| 6,220,015 B1 | | 4/2001 | Mina | |
| 6,334,294 B1 | * | 1/2002 | Belsom et al. | 60/39.02 |

FOREIGN PATENT DOCUMENTS

JP 356133538 A * 10/1981

* cited by examiner

*Primary Examiner*—Justine R. Yu
*Assistant Examiner*—John F. Belena
(74) *Attorney, Agent, or Firm*—Brian R. Mack

(57) ABSTRACT

A crossfire tube assembly with telescoping inner and outer crossfire tubes with an enhanced cooling mechanism for connecting adjacent combustors in a gas turbine is disclosed. The enhanced cooling configuration includes a plurality of channels formed in the telescoping region of the inner and outer crossfire tubes of the assembly to improve heat transfer and reduce local operating temperatures such that component life is extended.

14 Claims, 8 Drawing Sheets

ADVANCED CROSSFIRE TUBE COOLING SCHEME FOR GAS TURBINE COMBUSTORS

BACKGROUND OF THE INVENTION

1. Field of the Invention

This invention relates to gas turbine combustors and more specifically to an improved cooling scheme for a crossfire tube assembly, which interconnects adjacent can-annular combustors.

2. Description of Related Art

A combustion system for a gas turbine engine, especially those used to generate electricity, are comprised of a number of cylindrical combustors disposed in an annular array about the turbine, commonly referred to as a can-annular combustor. It is a common practice to join these individual combustors by a conduit referred to as a crossfire tube assembly, comprised of a plurality of tubes, to aid in cross ignition between combustors. In operation a combustor with an ignition source, typically a spark plug, ignites the fuel/air mixture and the sudden increase in pressure causes the reaction to pass through the crossfire tube assembly into the adjacent combustor, there by igniting the fuel/air mixture in the adjacent combustor. This process eliminates the need for ignition sources in each combustor.

The crossfire tube assembly engages the adjacent combustors and is held in place at each end by a fastening means such as a retaining clip. Each of the tubes, which together in a typical crossfire tube assembly, mate to each other at their respective free ends to allow combustion gases to pass between adjacent combustors. This intersection is typically a telescoping arrangement and due to assembly tolerances and operating issues this intersection is not adequately cooled and becomes the point of maximum operating temperature. The high temperatures cause premature deterioration of the tubes and in some cases burning of the free ends of the crossfire tubes within the assembly. Premature deterioration and burning of the crossfire tubes can cause damage to the surrounding combustion hardware as well.

SUMMARY AND OBJECTS OF THE INVENTION

It is an object of the present invention to provide a crossfire tube assembly for connecting adjacent combustors in a gas turbine engine.

It is yet another object of the present invention to provide a crossfire tube assembly having an improved cooling configuration to reduce component deterioration due to long-term exposure to elevated temperatures.

In accordance with these and other objects, which will become apparent hereinafter, the instant invention will now be described with particular reference to the accompanying drawings.

DETAILED DESCRIPTION OF THE PREFERRED EMBODIMENT

Figure 1:
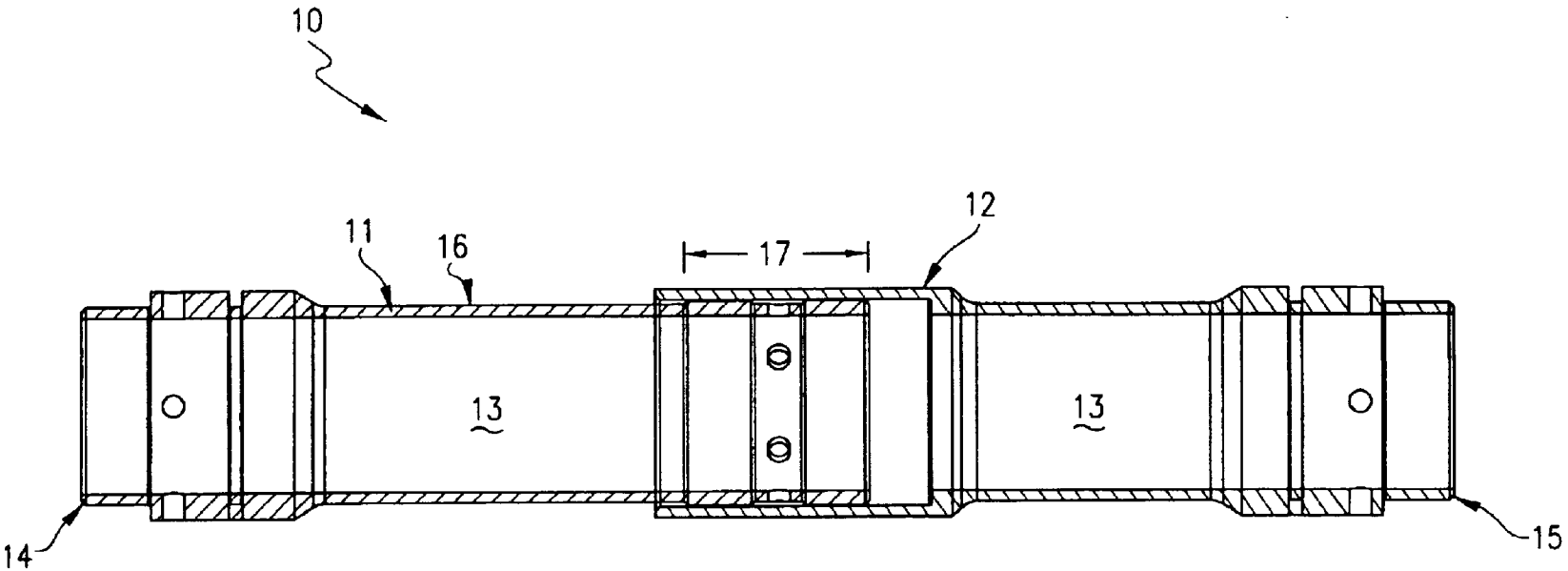
FIG. 1 PRIOR ART
FIG. 1 is a cross section view of the crossfire tube assembly of the prior art.

Referring to FIG. 1, a crossfire tubes assembly 10 in accordance with conventional design is shown. The assembly consists of an inner tube 11 and an outer tube 12. Inner tube 11 is telescopically received within outer tube 12. Combustion gases pass through passage 13, which is formed by the inner and outer tubes, and exit into adjacent combustors (not shown) at tube ends 14 and 15. Crossfire tube assembly 10 is contained within a generally annular plenum (not shown), which contains compressor discharge air for cooling. Ideally, cooling air passes along the outer wall 16 of inner tube 11 and into the telescoping region 17 of crossfire tube assembly 10, where the air continues to cool the outer wall 16 of inner tube 11. It has been determined through engine operations that this telescoping region 17 of crossfire tube assembly 10 is in fact not adequately cooled and excessive damage, including melting of inner tube 11 at this location, has been seen. Premature failure of these components requires earlier replacement and additional maintenance costs of the engines. The present invention, as described below, seeks to overcome these issues by providing an improved cooling configuration that directs cooling air along the inner tube outer wall, especially within the telescoping area between the inner and outer crossfire tubes.

Figure 2:
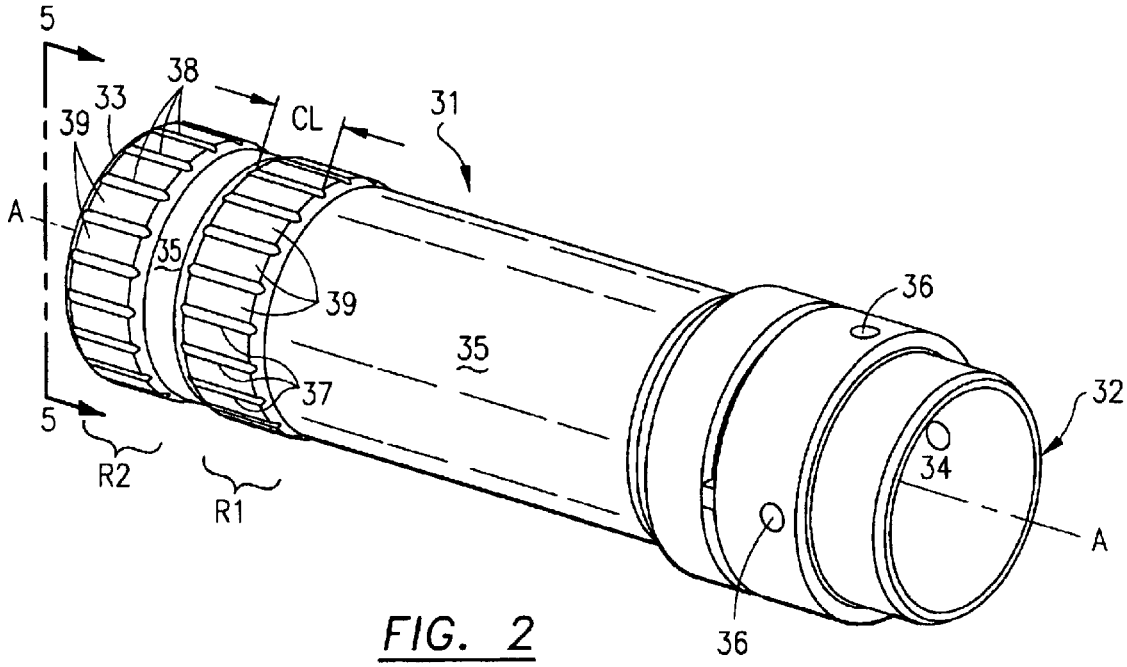
FIG. 2 is a perspective view of the hollow inner crossfire tube in accordance with the preferred embodiment of the present invention.
Figure 3:
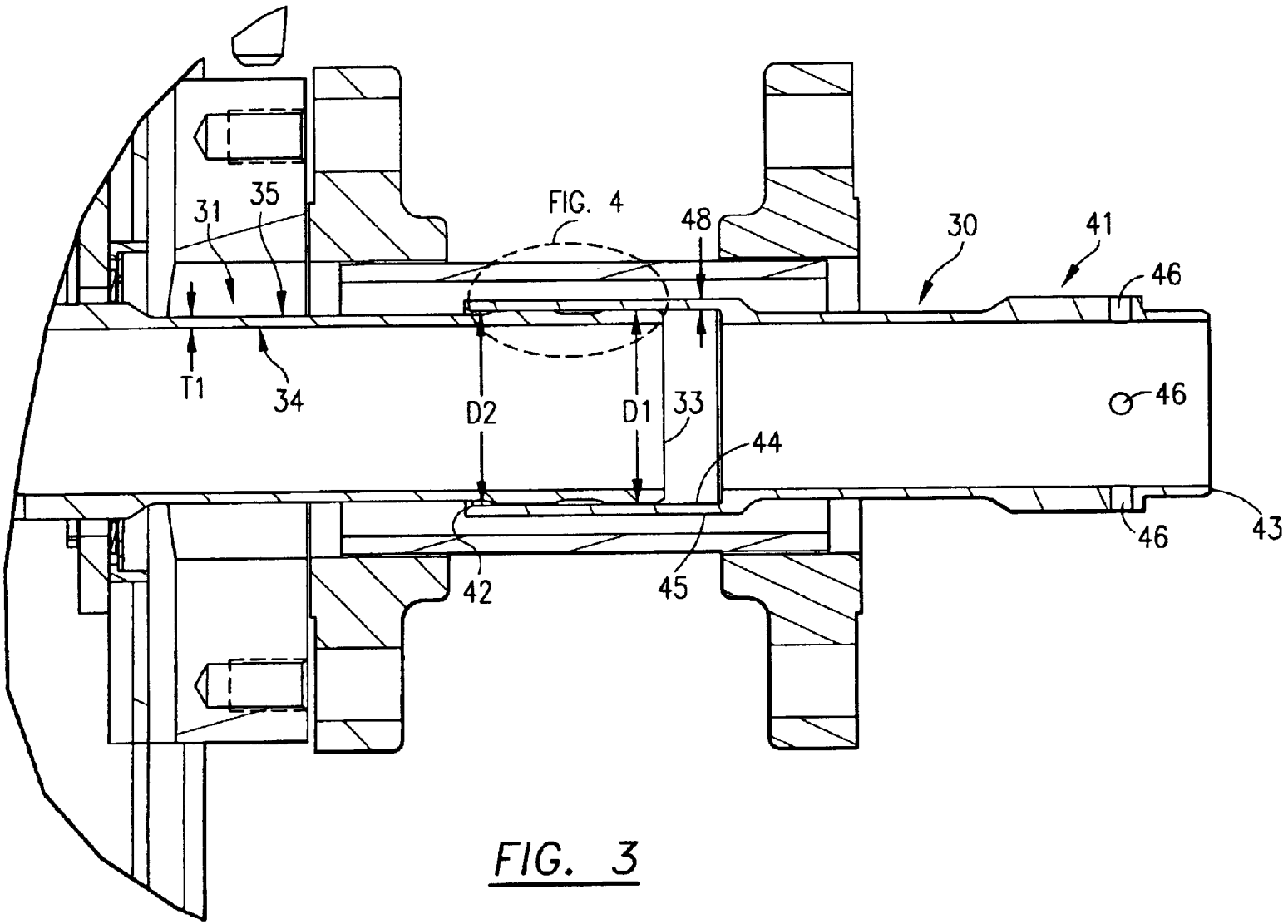
FIG. 3 is a partial cross section view of the crossfire tube assembly shown installed in the combustor in accordance with the preferred embodiment of the present invention.

Referring now to FIGS. 2 and 3, the crossfire tube assembly 30 of the present invention is shown. Crossfire tube assembly 30 includes an inner hollow tube 31 having a first inner end 32, a second inner end 33, a first inner wall 34 having a first axis A—A therethrough. Inner tube 31 further includes a first outer wall 35 coaxial with and radially outward from first inner wall 34, where the first outer wall 35 has a first diameter D1 at the second inner end 33. First inner wall 34 and first outer wall 35 thereby form a first thickness T1, typically at least 0.125 inches. The inner tube 31 also contains a plurality of first air purge holes 36, which are preferably proximate the first inner end 32. Additionally, inner tube 31 contains a plurality of channels 37 and 38 that extend along the first outer wall 35 proximate the second inner end 33 of inner tube 31. Each of channels 37 and 38 are separated from immediately adjacent channels by lands 39. The lands 39 are located in between channels 37 of row R1 and channels 38 of row R2. The lands serve as the contact location between first outer wall 35 and second inner wall 44.

Additionally, inner tube 31 contains a plurality of channels 37 and 38 that extend along the first outer wall 35 proximate the second inner end 33 of inner tube 31.

FIG. 3 shows, in detail, the hollow outer tube 41 of crossfire tube assembly 30. Outer tube 41 has a first outer end 42, a second outer end 43, a second inner wall 44 and a second outer wall 45 coaxial with a radially outward from second inner wall 44. Second inner wall 44 has a second diameter D2 at first outer end 42. Second inner wall 44 and second outer wall 45 thereby form a second thickness 48, typically at least 0.050 inches. Outer tube 41 further includes a plurality of second air purge holes 46 which are preferably proximate the second outer end 43.

Inner tube 31 is telescopically received in outer tube 41 to form crossfire tube assembly 30 due to the fact that the first diameter D1 of inner tube 31 is slightly less than the second diameter D2 of outer tube 41, such that the second inner end 33 of inner tube 31 is located radially inward from second inner wall 44 of outer tube 41. Therefore, the air volume within the first inner wall 34 communicates with the air volume outside of second outer wall 45 via channels 37 and 38.

Cooling the ends of the crossfire tubes is an important aspect to maintaining their integrity given the harsh operating conditions. The air purge holes, 36 and 46, of inner tube 31 and outer tube 41, respectively, consist of at least two holes which are preferably equally spaced about first end 32 of inner tube 31 and second end 43 of outer tube 41. Preferably, the air purge holes, 36 and 46, are at least 0.050 inches in diameter.

Figure 4:
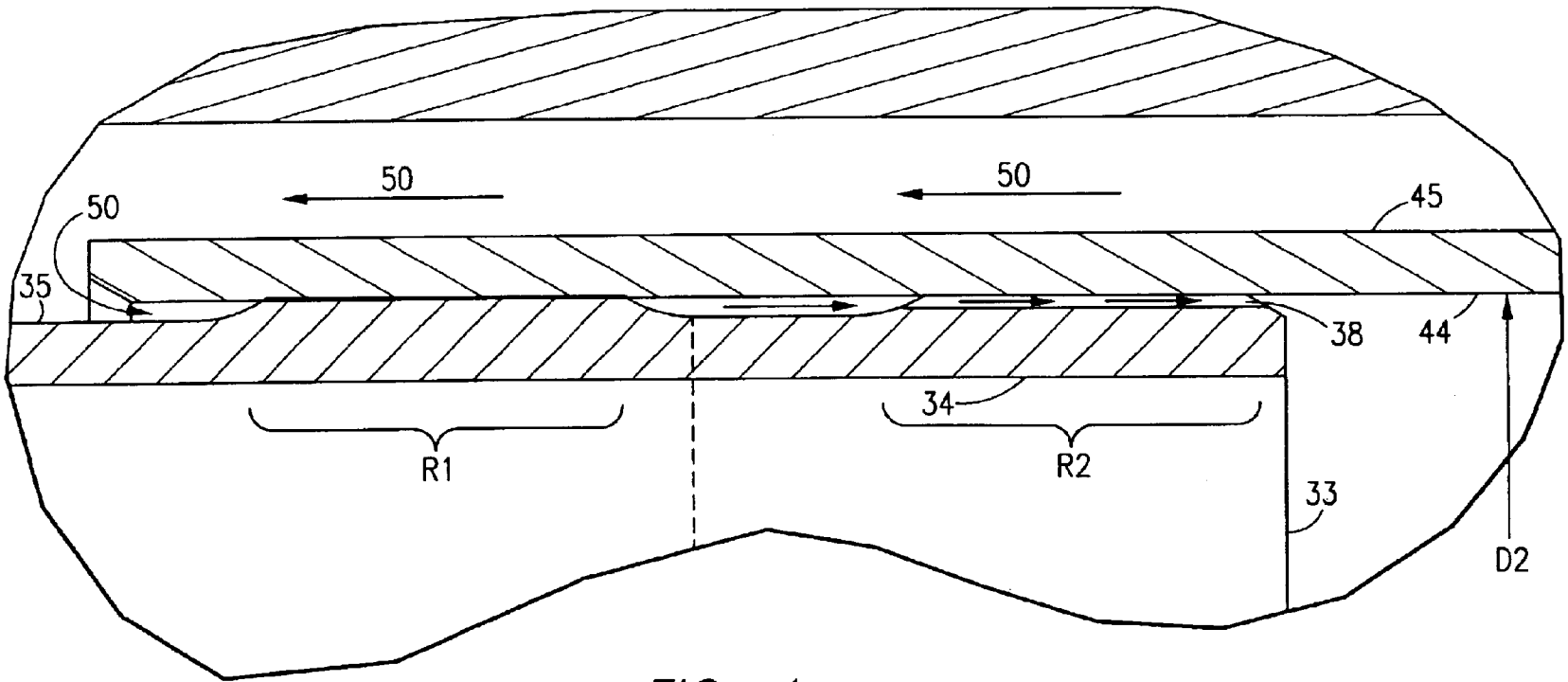
FIG. 4 is a detail view in cross section of the telescoping arrangement of the inner and outer tubes in accordance with the preferred embodiment of the present invention.

In order to adequately cool the telescoping connection of inner tube 31 to outer tube 41, channels 37 and 38 are formed along first outer wall 35 of inner tube 31, such that cooling air can pass along the telescoping walls. This configuration is detailed further in FIG. 4. In the preferred embodiment, channels 37 and 38 extend along first outer wall 35 in a direction such that they are parallel to axis A—A of inner tube 31. Channels 37 and 38 are separated into two distinct rows R1 and R2, respectively, separated by a section of first outer wall 35 of inner tube 31 (see FIG. 2), where Row R2 is proximate the second inner end 33. The second inner end 33 of inner tube 31 is cooled by compressor discharge air, shown by arrows 50 in FIG. 4. Compressor discharge air 50 passes along second outer wall 45 of outer tube 41 and along the first outer wall 35 of inner tube 31, where it then enters channels 37 and 38 of rows R1 and R2, thereby further cooling first outer wall 35. Cooling air 50 then flows along second inner wall 44 to further cool that wall before dissipating into the combustor.

Figure 5:
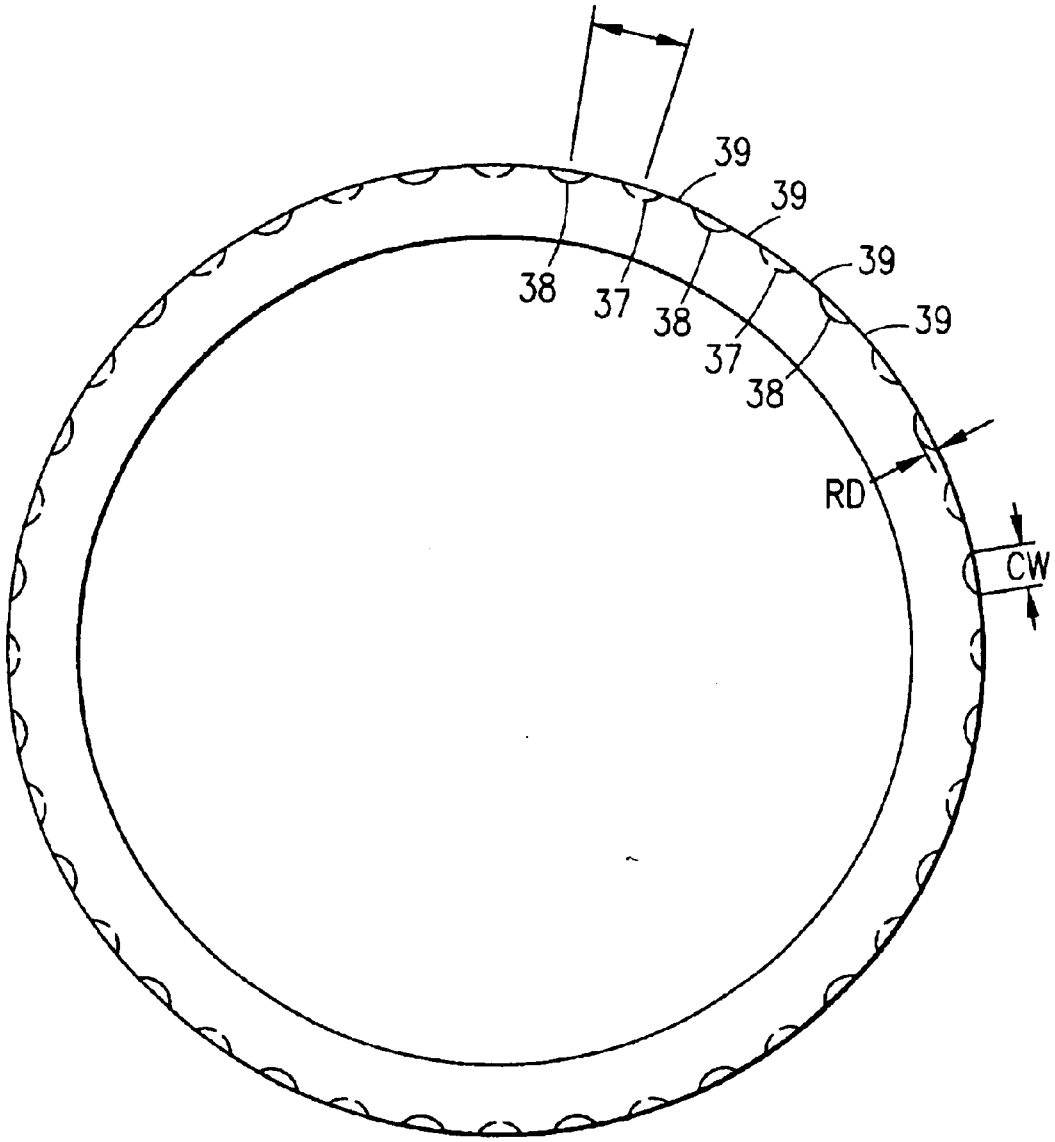
FIG. 5 is an end view, taken from FIG. 2, of the inner crossfire tube in accordance with the preferred embodiment of the present invention.

In order to provide the most efficient cooling, channels 37 and 38 should have an axial length CL, in a direction parallel to axis A—A of at least 0.0.50 inches, a circumferential width CW of at least 0.010 inches and a radial depth RD of at least 0.010 inches (see FIG. 5). Although not shown in the figures, it is to be understood that each of the channels 37 and 38 may have a circumferential length in addition to the axial length CL, resulting in channels that "spiral" about the tubes 31 and 41 on which they are located. Such spiral channels may be used in those situations where increased heat transfer to the cooling air is desired. In order to provide additional heat transfer and increase the effectiveness of the compressor discharge cooling air 50, the channels 37 and 38 are offset circumferentially relative to each other by an angle $\propto$, such that the cooling air from channels 37 does directly enter a channel 38. This offset relationship of the channels 37 and 38 in Rows R1 and R2 is shown in detail in FIG. 5. The preferred amount of angular offset is at least 5 degrees, but is dependent upon the amount of cooling required along inner tube 31.

Figure 6:
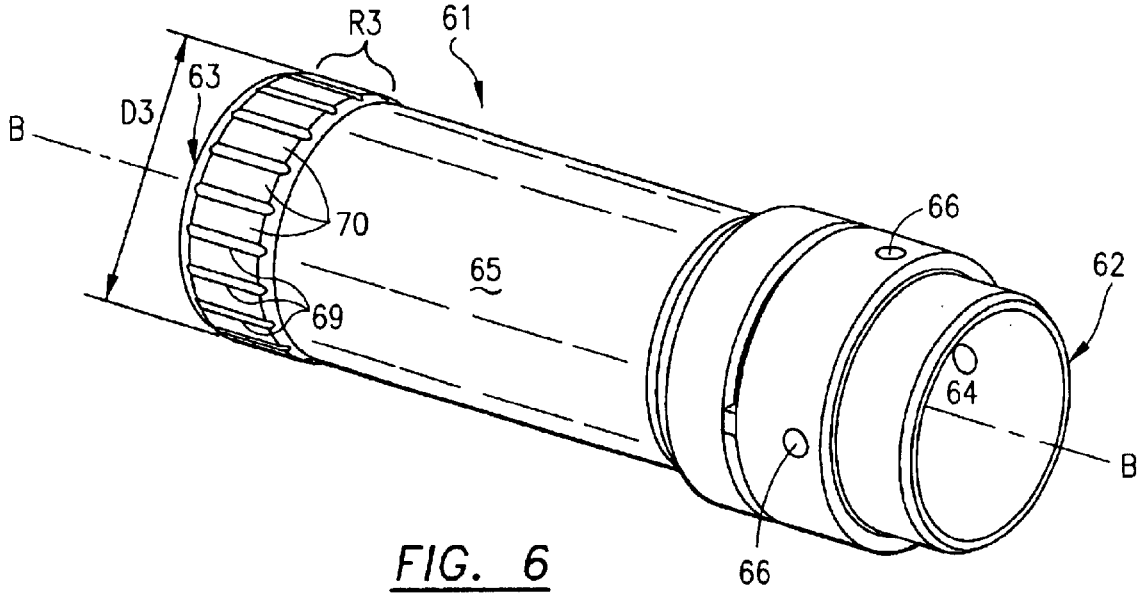
FIG. 6 is a perspective view of the hollow inner crossfire tube in accordance with an alternate embodiment of the present invention.

An alternate embodiment of the present invention is shown in FIG. 6. Inner tube 61, as with the preferred embodiment, has a first inner end 62, a second inner end 63, and a first inner wall 64 having a first axis B—B therethrough. Inner tube 61 further includes a first outer wall 65 coaxial with and radially outward from first inner wall 64, where the first outer wall 65 has a first diameter D3 at the second inner end 63. First inner wall 64 and first outer wall 65 thereby form a first thickness 68, typically at least 0.050 inches. The inner tube 61 alos contains a plurality of first air purge holes 66 which are preferably proximate the first inner end 62. Additionally, inner tube 61 contains a plurality of channels 69 that extend along the first outer wall 65 proximate the second inner end 63 of inner tube 61. Unlike the preferred embodiment, there is only one row, R3, of cooling channels 69 that are separated from immediately adjacent channels by a land 70. Lands 70 serve as the contact location between the first outer wall 65 of inner tube 61 and an outer crossfire tube.

Figure 7:
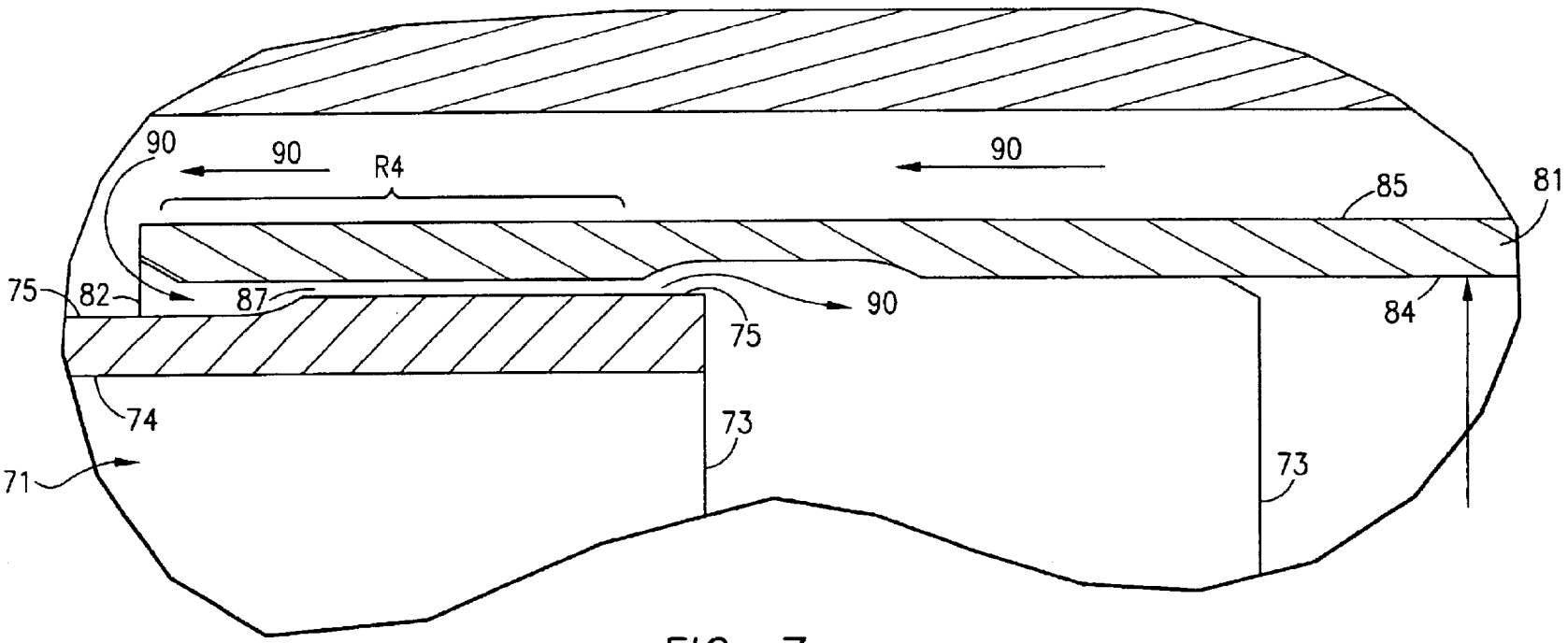
FIG. 7 is a detail view in cross section of the telescoping arrangement of the inner and outer tubes in accordance with an alternate embodiment of the present invention.
Figure 8:
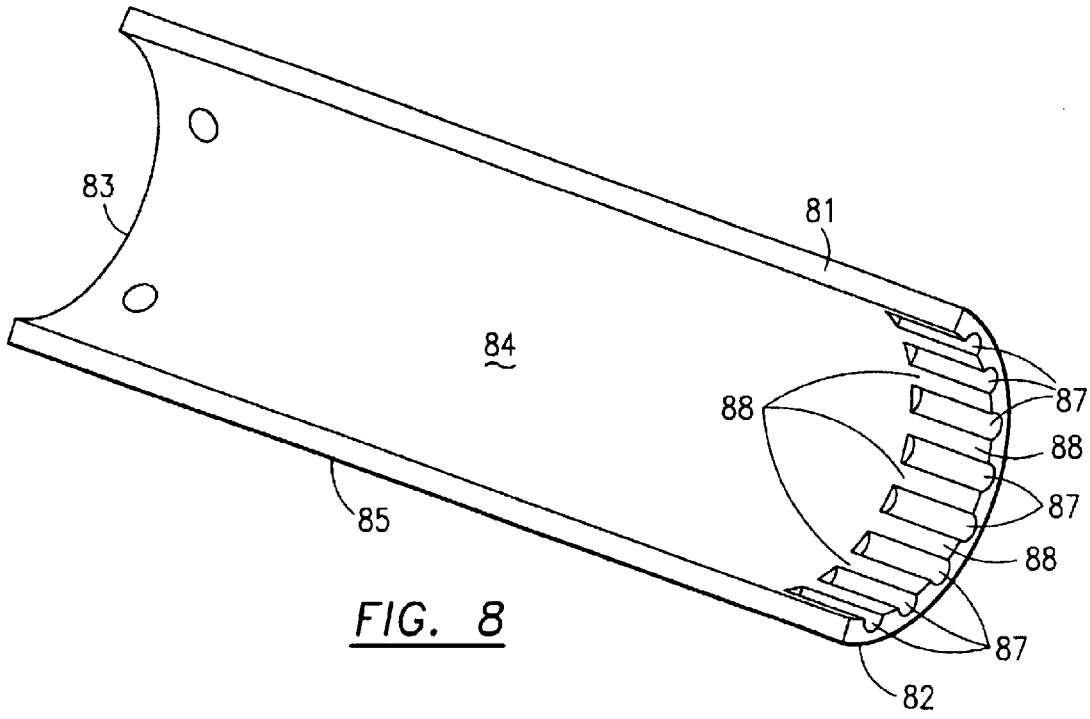
FIG. 8 is a perspective view in cross section of the outer tube in accordance with an alternate embodiment of the present invention.

In yet another embodiment of the present invention, the cooling channels, which on the preferred embodiment were located on the outer wall of the inner tube, are now located along the inner wall of the outer tube, as shown in FIGS. 7 and 8. FIG. 7 shows a detail view similar to that of FIG. 4, including inner tube 71 and outer tube 81. Inner tube 71 has first inner end 72, not shown, and second inner end 73. Outer tube 81 has a first outer end 82 and second outer end 83. All other features of the inner and outer tubes of this embodiment are identical to those described in FIGS. 2–5, with the exception of the cooling channels 87. Cooling channels 87 formed in Row R4 are located along the second inner wall 84 of outer tube 81, and are separated from immediately adjacent channels by a land 88. Lands 88 serve as the contact location between the second inner wall 84 of outer tube 81 and an inner crossfire tube. Compressor discharge cooling air 90 passes along the first outer wall 75 and second outer wall 85 of inner tube 71 and outer tube 81 where it then enters channels 87 of rows R4, thereby further cooling first outer wall 75. Cooling air 90 then flows along second inner wall 84 to further cool that wall before dissipating into the combustor.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A crossfire tube assembly for connecting adjacent combustors in a gas turbine, said crossfire tube assembly comprising:

a hollow inner tube having a first inner end, a second inner end, a first inner wall having a first axis defined therethrough, and a first outer wall coaxial with and radially outward from said first inner wall, said first outer wall having a first diameter at said second inner end, said inner tube having a plurality of first air purge holes extending from said first outer wall to said first inner wall, a plurality of channels extending along said first outer wall proximate said second inner end, and a plurality of lands located between said channels;

a hollow outer tube having a first outer end, a second outer end, a second inner wall, and a second outer wall coaxial with and radially outward from said second inner wall, said second inner wall having a second diameter at said first outer end, said outer tube having a plurality of second air purge holes extending from said second outer wall to said second inner wall;

wherein said first diameter is slightly less than said second diameter, a portion of said hollow inner tube is telescopically received within said hollow outer tube, said second inner end is located radially inward from said second inner wall, and each of said channels is separated from immediately adjacent channels by one of said lands.

2. The crossfire tube assembly of claim 1 wherein said first inner wall is spaced radially inward from and said first outer wall thereby defining a first thickness of at least 0.050 inches, and said second inner wall is spaced radially inward from said second outer wall thereby defining a second thickness of at least 0.050 inches.

3. The crossfire tube assembly of claim 1 wherein said plurality of air purge holes comprise at least two holes equally spaced about each of said first end of said inner tube and said second end of said outer tube.

4. The crossfire tube assembly of claim 3 wherein each of said air purge holes has a diameter of at least 0.050 inches.

5. The crossfire tube assembly of claim 1 wherein said plurality of channels extend in a direction substantially parallel to said first axis.

6. The crossfire tube assembly of claim 1 wherein said plurality of channels have an axial length of at least 0.050 inches, a circumferential width of at least 0.010 inches, and a radial depth of at least 0.010 inches.

7. The crossfire tube assembly of claim 1 wherein said plurality of channels are separated into a first row and a second row by a section of tubing without channels.

8. The crossfire tube assembly of claim 7 wherein said first row of channels is offset circumferentially from said second row of channels by an angle of at least 5 degrees.

9. A crossfire tube assembly for connecting adjacent combustors in a gas turbine, said crossfire tube assembly comprising:

a hollow inner tube having a first inner end, a second inner end, a first inner wall, and a first outer wall coaxial with and radially outward from said first inner wall, said first outer wall having a first diameter at said second inner end, said inner tube having a plurality of first air purge holes extending from said first outer wall to said first inner wall;

a hollow outer tube having a first outer end, a second outer end, a second inner wall having a second axis defined therethrough, and a second outer wall coaxial with and radially outward from said second inner wall, said second inner wall and having a second diameter at said first outer end, said outer tube having a plurality of second air purge holes extending from said second outer wall to said second inner wall, a plurality of channels extending along said second inner wall proximate said first outer end, and a plurality of lands located between said channels;

wherein said first diameter is slightly less than said second diameter, a portion of said hollow inner tube is telescopically received within said hollow outer tube, said second inner end is located radially inward from said second inner wall, and each of said channels is separated from immediately adjacent channels by one of said lands.

10. The crossfire tube assembly of claim 9 wherein said first inner wall is spaced radially inward from said first outer wall thereby defining a first thickness of at least 0.050 inches, and said second inner wall is spaced radially inward from said second outer wall thereby defining a second thickness of at least 0.050 inches.

11. The crossfire tube assembly of claim 9 wherein said plurality of air purge holes comprise at least two holes spaced about each of said first end of said inner tube and said second end of said outer tube.

12. The crossfire tube assembly of claim 11 wherein each of said air purge holes has a diameter of at least 0.050 inches.

13. The crossfire tube assembly of claim 9 wherein said plurality of channels extend in a direction substantially parallel to said first axis.

14. The crossfire tube assembly of claim 9 wherein said plurality of channels have an axial length of at least 0.050 inches, a circumferential width of at least 0.010 inches, and a radial depth of at least 0.010 inches.

* * * * *